United States Patent [19]

Espander

[11] 4,085,843

[45] Apr. 25, 1978

[54] THERMOSTAT

[75] Inventor: John C. Espander, Burnsville, Minn.

[73] Assignee: Honeywell Inc., Minneapolis, Minn.

[21] Appl. No.: 747,834

[22] Filed: Dec. 6, 1976

[51] Int. Cl.[2] ..... B65D 85/00; B65D 85/38

[52] U.S. Cl. ..... 206/328; 337/380; 206/320

[58] Field of Search ..... 337/380, 298; 206/328, 206/329, 320; 229/87 H

[56] References Cited

U.S. PATENT DOCUMENTS

| | | | |
|---|---|---|---|
| 2,004,878 | 6/1935 | MacNaught | 229/87 H |
| 2,661,836 | 12/1953 | Jewell | 206/320 |
| 3,198,324 | 8/1965 | Kallenbach et al. | 206/320 |
| 3,575,288 | 4/1971 | Brucken | 206/320 |
| 3,707,040 | 12/1972 | Lehmann | 206/328 |
| 3,796,304 | 3/1974 | Blais | 206/328 |
| 3,797,645 | 3/1974 | Forsyth et al. | 206/328 |

*Primary Examiner*—Harold Broome
*Attorney, Agent, or Firm*—John S. Munday

[57] ABSTRACT

A thermostat for mounting on a wall, including a base having an aperture for mounting on the wall, a temperature sensing means mounted on the base and adapted to move with changes in temperatures, and switching means mounted on the base and adapted to operate when the temperature sensing means reaches a predetermined temperature. Also included are restraining means removably attached to the switching means and adapted to restrain the switching means during shipment of the thermostat from the factory to the place of installation, the restraining means being positioned in the aperture to prevent mounting of the base to the wall without removal of the restraining means from the switching means.

6 Claims, 1 Drawing Figure

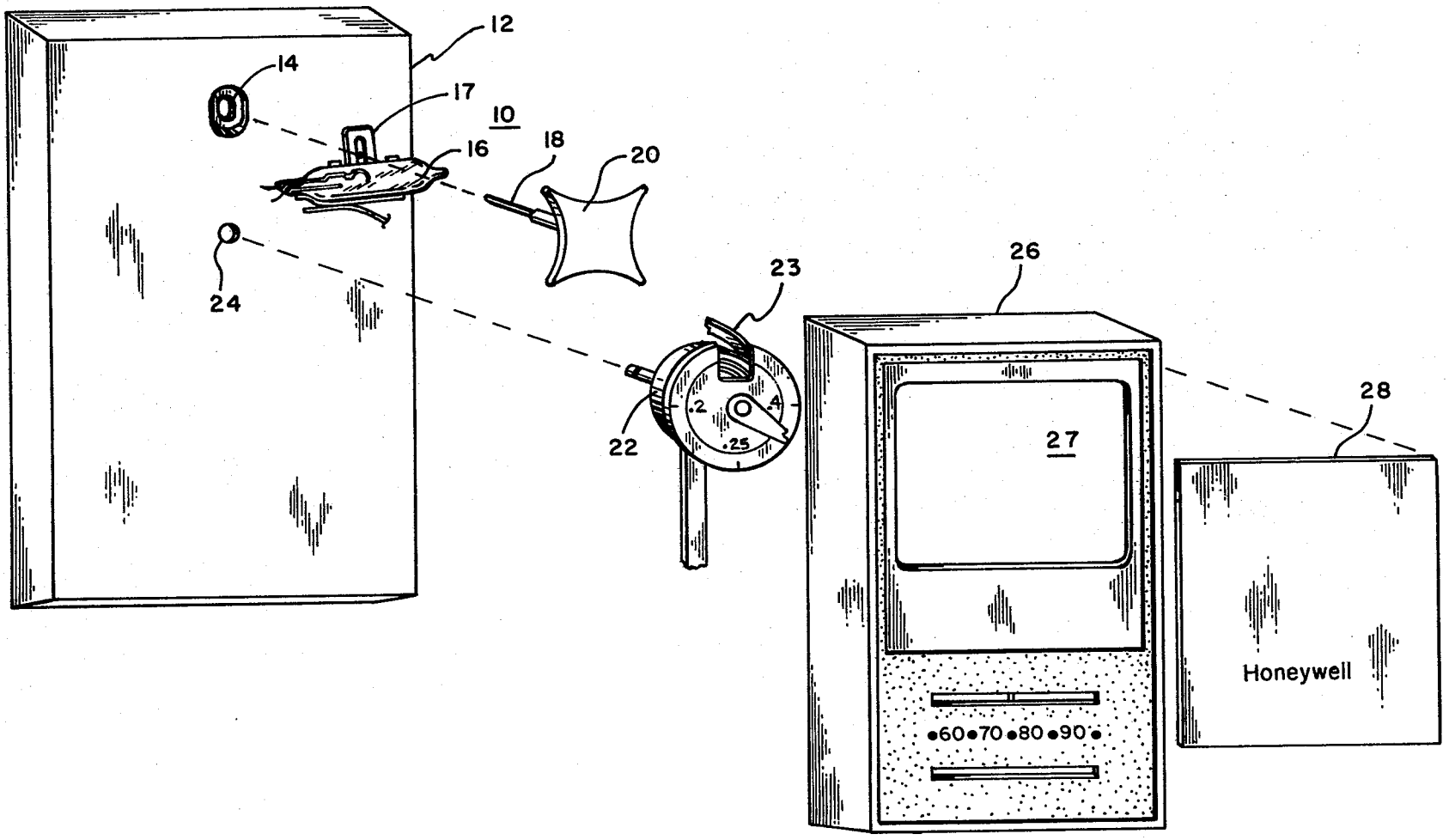
28
Honeywell
26
27
60 70 80 90
23
.4
.25
.2
22
20
18
10
12
17
16
14
24

THERMOSTAT

BACKGROUND OF THE INVENTION

Thermostats are one of many mass-produced products for the home which are considered to be essential for comfortable operation but which should not impart a significant cost to the user. Modern-day thermostats have a degree of accuracy and a simplicity of manufacture which are meeting all but the most complicated needs for heat and airconditioning control. Because of the simplicity of design, there are relatively few parts and operation can continue with reasonably acceptable accuracy for an indefinite but extensive period of time.

In order to achieve economy of installation, it has been found most efficient to calibrate the thermostat at the point of manufacture. This is particularly true in case of thermostats which employ a bimetal coil of metals which expand or contract as the temperature changes and which actuate a switch at a predetermined temperature. In many instances, the switch is a simple mercury switch which gives a positive open and closed response with the degree of accuracy desired for maintenance of home temperature and airconditioning. This bimetal temperature sensing means is adjustable in the home or other place of use over a relatively narrow range of temperature. To insure that the bimetal material functions properly within this very narrow temperature range, the position of the coil is adjusted at the factory to give adequate response in conjunction with the switch. Thus the thermostat may be attached to the wall of the room being controlled and connected to the electrical circuit without extensive calibration by a service man at the time of installation.

One major problem in shipping precalibrated thermostats for installation is that it is possible for the calibration to be inadvertently changed. On the site, calibration of a thermostat which is badly out of adjustment can sometimes cost more than the device itself. If this adjustment is done under warranty, the profitability of the product is substantially lessened.

The industry has solved this problem by the use of various shipping inserts which restrain and protect the temperature sensing means or the switching means during transit. However, even though installation manuals and service manuals are written to specifically and emphatically instruct the installation personnel to remove the shipping insert, this removal does not always take place. In point of fact, one of the largest, if not the largest, sources of repair for newly installed thermostats is to have a separate service call during which the repairmen merely remove the shipping insert which should have been removed during installation. While this may seem elementary, many times in the haste of assembling a complete heat control system, perhaps including a furnace or air conditioner, the serviceman does not remove the shipping insert. This results in a thermostat which is totally unresponsive to the needs of the user.

Accordingly, it is an object of this invention to provide a thermostat which is suitable for calibration at the factory, may be shipped without concern for damage to the calibration, and which may be installed simply and efficiently in a manner which requires removal of the shipping insert prior to installation. Other objects will appear hereinafter.

BRIEF DESCRIPTION OF THE INVENTION

It has now been discovered that the above and other objects of the present invention may be accomplished in the following manner. Specifically, a thermostat has been discovered which is suitable for mounting on a wall and which comprises a base, having an aperture therein for mounting to a wall, a temperature sensing means mounted on the base, and adapted to move with changes in temperature, switching means mounted on the base, and adapted to operate when said temperature sensing means reaches a predetermined temperature, and restraining means removably attached to the switching means and adapted to restrain the switching means during shipment of the thermostat while simultaneously being positioned to prevent mounting of the base to a wall without removal of the restraining means from the switching means by placement of at least a portion of the restraining means in the aperture for mounting on a wall. In a preferred embodiment, the temperature sensing means is a bimetal coil. Also preferred is a mercury switch for use as a switching means. The invention further contemplates, in at least a preferred embodiment, the use of a cover means for enclosing the switching means on the base, whereby the cover means is removable to permit access to the aperture for mounting the thermostat on the wall. The cover means should include an aperture positioned in approximately axial alignment with the base aperture, and should be of sufficient size to permit insertion of the switching means at the factory, such that a restraining means will obstruct the base aperture until it is removed. Further contemplated is a face plate means for permanently covering the aperture after insertion of the restraining means at the factory.

DETAILED DESCRIPTION OF THE INVENTION

For a more complete understanding of the present invention, reference is hereby made to the drawing, in which an exploded view is presented of a preferred embodiment according to the present invention.

As shown in the FIGURE, portions of a thermostat which are a part of the present invention are illustrated for attachment to a wall 10. Specifically, the base 12 of the thermostat has an aperture 14 through which a screw or other fastening device may be placed to mount the thermostat on the wall. A switching means 16, which in the preferred embodiment shown herein is a simple and conventional mercury switch, is aligned with the aperture 14 such that a tube clip 17 is axially aligned with the aperture 14. A restraining means 20 having an elongated portion 18 can then be centered through the tube clip 17 and the aperture 14 to prevent movement of the mercury switch 16.

A temperature sensing element 22 having a bimetal 23 is attached to the base 12 through aperture 24 and is permanently adjusted at the factory to cause the mercury switch 16 to operate over the desired temperature range. Once this adjustment has been made at the factory, the shipping insert 20 restrains the switching means 16 from becoming out of adjustment. A cover means 26 is shown for use with the base 12 as is conventional in the thermostat art. The cover 26 has a large aperture 27 which permits adjustment of the switch 16 and the temperature sensing means 22 at the factory prior to insertion of the restraining means 18. A face plate 28, having suitable adhesive thereon, is then placed over the aperture 27 on the cover 26 after the calibration and insertion of the restraining means 18.

During installation of the thermostat to a wall, the serviceman will find it necessary to remove removable cover 26 from the base 12 in order to mount the thermostat to the wall or wall stud. Upon removal of the cover 26 the restraining means 20 will oftentimes fall to the floor. Even if it remains in aperture 14, it must be removed by the serviceman prior to placement of the fastening means through aperture 14. Once aperture 14 has been used for mounting the base 12, the restraining means 20 can no longer be reinstalled since the elongated member 18 is greater in length than the distance from the base 12 to the outermost portion 28 of the cover 26. Thus the thermostat is installed as calibrated and the serviceman has no choice but to discard the shipping insert 20.

While a specific embodiment of this invention has been shown and described, further modifications and improvements will occur to those skilled in the art. It is desired that this invention be not limited to the particular form shown, but it is intended that the appended claims cover all modifications which do not depart from the spirit and hope of the present invention.

What is claimed is:

1. A thermostat, for mounting on a wall, comprising:

a base, having an aperture therein for mounting to the wall;

a temperature sensing means mounted on said base, and adapted to move with changes in temperature;

switching means mounted on said base, and adapted to operate when said temperature sensing means reaches a predetermined temperature; and a restraining means removably attached to said switching means and adapted to restrain said switching means during said shipment of said thermostat, said restraining means being positioned in said aperture means to prevent mounting of said base to a surface without removal of said restraining means from said switching means.

2. The thermostat of claim 1, wherein said temperature sensing means includes a metal coil.

3. The thermostat of claim 2, wherein said switching means includes a mercury switch.

4. The thermostat of claim 3, wherein said restraining means has a first elongated portion passing through said aperture and said switching means to restrain said switching means, and a second flat portion perpendicular to said first portion and located at the end of said first portion furthest from said aperture.

5. The thermostat of claim 4, which further includes cover means for enclosing said switching means on said base, said cover means being removable to permit access to said aperture, said cover means being constructed such that a distance from said aperture to the other portion of said cover means is less than the length of said elongated portion of said restraining means.

6. The thermostat of claim 5, wherein said cover means further includes an aperture positioned in approximately axial alignment with said base aperture, said cover aperture being of sufficient size to permit insertion of said restraining means, and wherein said cover means further includes face plate means for permanently covering said cover aperture.

* * * * *